US005174444A

United States Patent [19]

Adams et al.

[11] Patent Number: 5,174,444

[45] Date of Patent: Dec. 29, 1992

[54] TWO CARTONS JOINED AS A DUAL CARTON SEPARABLE INTO TWO INDIVIDUAL CARTONS

[75] Inventors: John M. Adams, Mechanicsville; Christopher N. Chance, Richmond; James A. DeBlasio, Midlothian; Donald H. Evers, Richmond; William C. Harris, Jr., Midlothian; Michael A. Kirby, Sr., Trevilians; Reginald W. Newsome, Richmond; Robert E. Talley, Chester, all of Va.

[73] Assignee: Philip Morris Incorporated, New York, N.Y.

[21] Appl. No.: 831,348

[22] Filed: Feb. 5, 1992

Related U.S. Application Data

[63] Continuation-in-part of Ser. No. 774,529, Oct. 8, 1991.

[51] Int. Cl.[5] ..... B65D 85/10; B65D 5/54

[52] U.S. Cl. ..... 206/256; 53/448; 53/462; 206/813; 206/273; 229/120.011

[58] Field of Search ..... 53/448, 449, 462, 416, 53/466, 443; 206/813, 273, 271, 256; 229/120.011, 120.09

[56] References Cited

U.S. PATENT DOCUMENTS

| | | | |
|---|---|---|---|
| 2,109,583 | 3/1938 | Bennett | 206/813 |
| 2,390,412 | 12/1945 | Axberg | 229/51 |
| 2,565,509 | 8/1951 | Marcin | 206/813 |
| 2,605,897 | 8/1952 | Rundle | 206/264 |
| 2,697,544 | 12/1954 | Morand | 229/120.04 |
| 2,871,080 | 1/1959 | Shelly | 229/120.01 |
| 2,895,601 | 7/1959 | Krukonis | 206/256 |
| 2,973,130 | 2/1961 | Cottrill | 229/51 |
| 3,071,244 | 1/1963 | Doran | 206/273 |
| 3,082,929 | 3/1963 | Aquino et al. | 206/256 |
| 3,086,650 | 4/1963 | Chapman et al. | 206/273 |
| 3,113,673 | 12/1963 | Stein | 206/65 |
| 3,135,457 | 6/1964 | Risucci | 229/120.011 |
| 3,144,190 | 8/1964 | Holt et al. | 229/27 |
| 3,163,351 | 12/1964 | Borgardt | 206/256 |
| 3,447,733 | 6/1969 | Smith et al. | 206/491 |
| 3,503,568 | 3/1970 | Galley | 242/74 |
| 3,536,246 | 10/1970 | Rosen | 206/256 |
| 3,596,758 | 8/1971 | Phillips, Jr. | 206/256 |
| 3,721,335 | 3/1973 | Grant | 206/256 |
| 3,752,308 | 8/1973 | Begemann | 206/273 |
| 3,759,378 | 9/1973 | Werth | 206/429 |
| 3,809,227 | 5/1974 | Begemann | 206/264 |
| 4,424,658 | 1/1984 | Focke | 53/398 |
| 4,441,611 | 4/1984 | Sommariva | 206/431 |
| 4,485,926 | 12/1984 | Lenzmeier | 206/602 |
| 4,631,900 | 12/1986 | Mattei et al. | 53/448 |
| 4,669,611 | 6/1987 | Flaherty | 206/449 |
| 4,738,359 | 4/1988 | Phillips, Jr. | 206/256 |
| 4,928,817 | 5/1990 | Focke | 206/264 |
| 4,932,534 | 6/1990 | Focke et al. | 206/602 |
| 5,058,363 | 10/1991 | Focke et al. | 53/462 |

FOREIGN PATENT DOCUMENTS 358560 10/1931 United Kingdom .

*Primary Examiner*—William I. Price

*Attorney, Agent, or Firm*—Jeffrey H. Ingerman; Karen G. Horowitz

[57] ABSTRACT

A dual carton formed from two substantially identical individual cartons secured together along their top flaps such that the means for securing the cartons is not readily apparent to a consumer. An additional means for securing the individual cartons together is provided across the bottom walls of the individual cartons. A dual cigarette carton of dimensions compatible with tax-stamping machinery is also shown.

25 Claims, 3 Drawing Sheets

TWO CARTONS JOINED AS A DUAL CARTON SEPARABLE INTO TWO INDIVIDUAL CARTONS

CROSS REFERENCE TO RELATED APPLICATION

This is a continuation-in-part of copending, commonly-assigned United States patent application Ser. No. 07/774,529, filed Oct. 8, 1991, which is hereby incorporated by reference in its entirety.

BACKGROUND OF THE INVENTION

This invention relates to the connection of two separate cartons to form a dual carton, and more particularly to the connection of cigarette cartons.

Cigarette packs (which usually contains twenty cigarettes) are generally rectangular in shape, having front and back long walls and two short side walls. Cigarette cartons typically contain two rows of five cigarette packs per row (each row arranged so that the front long walls of the packs are in the same plane and the back long walls are in a parallel plane spaced from the front long walls), and are generally known in the art as ten-pack cartons Such cigarette cartons are generally filled with cigarette packs by the manufacturer, temporarily closed (e.g., by folding the top flap of the carton over the box and releasably securing the flap in the closed position), and shipped to various distributors. The distributors generally open the cartons, after they are received, to apply the tax stamp that may be required by the jurisdiction in which they operate to the ends of the individual cigarette packs inside the cartons. Such procedures are commonly automated to reduce time, cost, and labor through the use of specially designed machines for applying tax stamps. Tax-stamping machines have been developed to open the cartons, apply the stamps, and finally seal the cartons for distribution. Such machines are generally commercially available, and are well known in the art. These machines have been developed for standard ten-pack cigarette cartons. A typical tax-stamping machine is model FUSON manufactured by Meyercord of 365 East North Avenue, Carol Stream, Ill. 60187.

Single row cigarette cartons which are dimensioned to contain one row of five cigarette packs (each pack usually containing twenty cigarettes, the packs arranged so that the front long walls of the packs are in the same plane and the back long walls are in a parallel plane spaced from the front long walls), i.e., five-pack cartons, are also known in the art. However, although machinery exists for manufacturing such cartons, machinery does not exist for stamping the cigarette packs contained in such cartons. Consequently, such cartons are usually put into scored, glued, and collapsed cartons to be hand-stamped (as is done currently), or would have to be secured together in pairs to be run through the existent tax-stamping equipment in which packs in double row cartons are stamped. To assure that the tax stamp is properly registered, the means for securing the cartons must be strong enough to keep the cartons together such that they are not sheared apart by the vertical rollers of the tax-stamping machines which roll along the vertical walls of the cartons to transfer the cartons between the various stages of the process.

After the cigarette cartons are passed through a tax-stamping machine, the individual cartons must be sealed so that they may be distributed for sale. It would be desirable to seal the cartons such that they may be sold together, as a dual carton, or, alternatively, such that they may be separated before reaching the consumer or separated by the consumer without disfiguring either of the individual cartons.

SUMMARY OF THE INVENTION

It is therefore an object of this invention to provide a means for joining and sealing two individual cartons such that the cartons may be sold together as a dual carton, without the means for joining and sealing the cartons being readily apparent.

It is another object of this invention to provide a means for joining and sealing two individual cartons such that the cartons remain sufficiently sealed when they are separated.

It is a further object of this invention to provide means for making a clean separation between two individual cartons initially joined together so that the individual cartons may be sold separately with minimal marks left from the means for joining the cartons.

These and other objects of the invention are accomplished in accordance with the principles of the invention by joining two cartons, each having two top flaps, along the walls from which the top flaps extend. The top flaps of the joined walls are folded over their respective cartons and a joining strip is applied over them, hence extending across the two cartons, as well. The remaining top flaps are folded over their respective cartons and adhered to the joining strip to thereby seal the cartons. Once the cartons are sealed, the joining strip is not readily visible. Preferably, a line of perforations is provided along the joining strip and positioned along the plane of abutment of the two cartons to facilitate separation of the two cartons, if desired. The cartons may be separated without leaving noticeable fraying along the joining strip.

BRIEF DESCRIPTION OF THE DRAWINGS

Further features of the invention, its nature, and various advantages will be more apparent from the following detailed description of the preferred embodiments and the accompanying drawings wherein like reference characters represent like elements throughout, and in which.

DETAILED DESCRIPTION OF THE INVENTION

Figure 1:
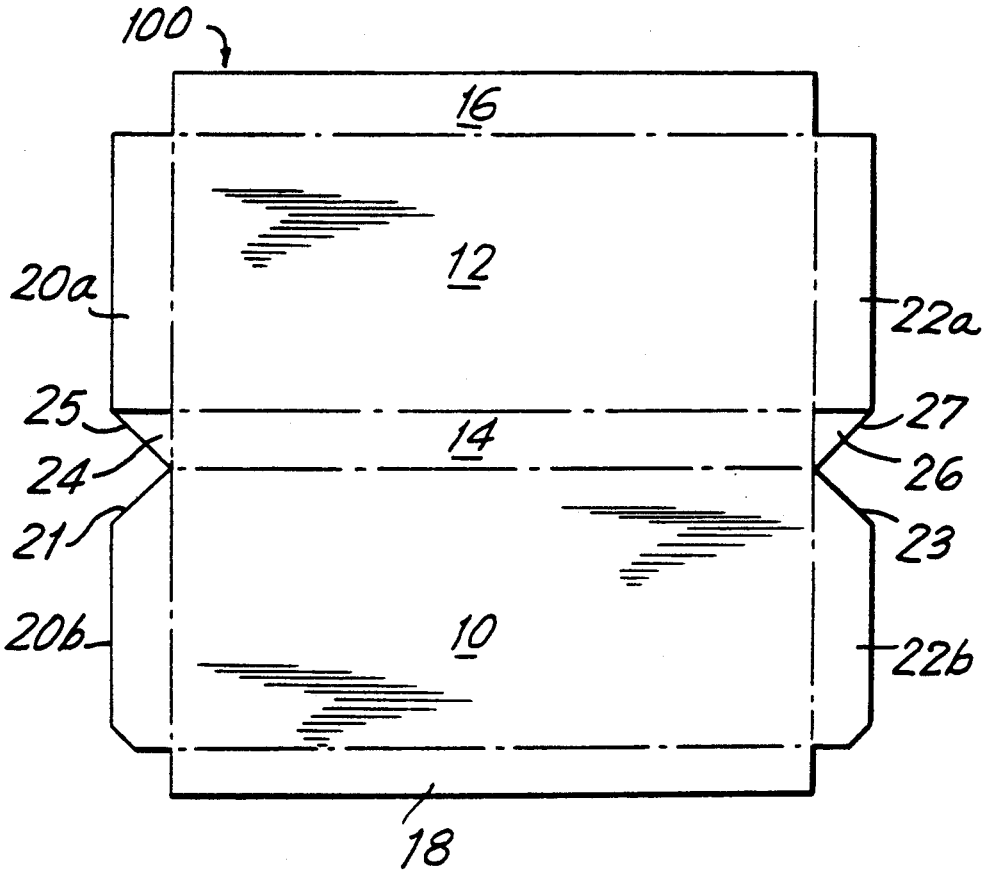
FIG. 1 is a plan view of an illustrative carton blank for a five-pack carton in accordance with this invention.

The dual carton of this invention is formed from two individual cartons which are each preferably formed from a blank such as blank 100, shown in FIG. 1. Blank 100, which is preferably formed from a substantially rigid material such as paperboard, is folded along a plurality of fold lines, represented by broken lines not all individually labeled, to form a carton such as carton 30 or 32. Panels 10 and 12 are preferably substantially five times the width of a long wall of a cigarette pack to be enclosed in the completed carton. Panel 20*a* and panel 20*b* are folded over one another to form side wall 20 of the completed carton, and panel 22*a* and 22*b* are folded over one another to form side wall 22 of the completed carton. Each side wall 20, 22 is preferably sufficiently wider than the short wall of a cigarette pack to be contained in the completed carton so that the pack fits in the carton. As used herein, a cigarette pack is defined as any pack commonly used for holding a predetermined number of cigarettes, and generally having front and back long walls connected by two short side walls. Hence, the carton is preferably dimensioned to contain five packs of cigarettes, having long walls parallel carton walls 10 and 12, and short walls parallel side walls 20 and 22 of the carton. Panel 14 forms the bottom wall of the carton, and extension panels/flaps 16 and 18, which extend from panels 12 and 10, respectively, are folded over one another, when the carton is completed, to form the top wall of the carton when the carton is sealed. Preferably at least flap 16 is the same dimension as panel 14. Dust flaps 24 and 26 are preferably folded perpendicular to panel 14 and lie adjacent the interior of the formed carton, substantially parallel and along the inside of walls 20 and 22. Preferably panel 20*a* and panel 22*a* are folded over panel 20*b* and 22*b*, respectively, such that cut edge 21 on panel 20*b* aligns with cut edge 25 on flap 24, and cut edge 23 on panel 22*b* aligns with cut edge 27 on flap 26.

Figure 2:
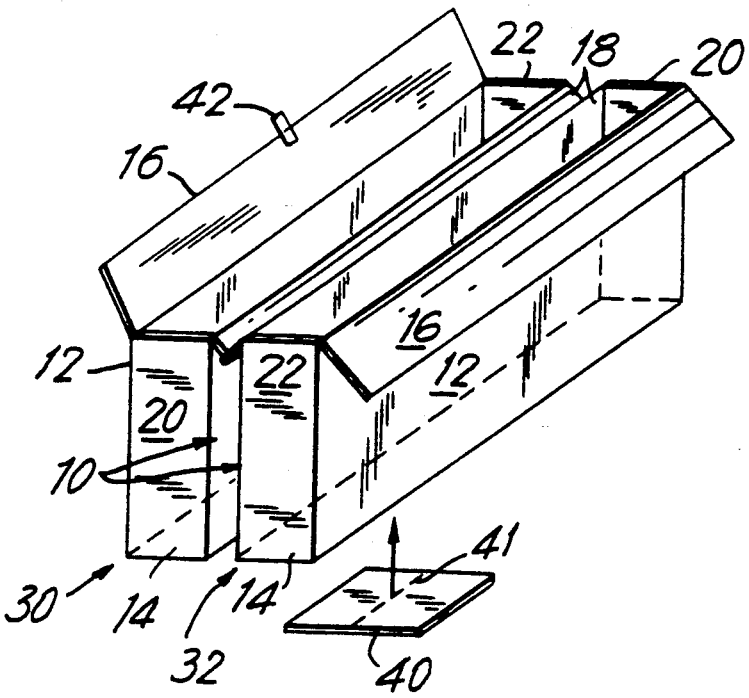
FIG. 2 is an isometric view showing the connection of two five-pack cartons to form a dual carton.

Completed cartons 30 and 32, preferably each formed from a blank such as blank 100, are shown in FIG. 2 positioned next to one another for joining. A carrier means bearing adhesive, such as described in aforementioned patent application Ser. No. 07/774,529, is positioned across the bottom walls of the cartons. For example, label 40, preferably having a weakened line, such as perforated line 41, is positioned across bottom walls 14 of cartons 30, 32 to thereby join the cartons. Perforated line 41 is preferably positioned along the adjoining edges of bottom walls 14, 14 to facilitate later separation of the cartons, if desired. Label 40 may bear pricing indicia, such as U.P.C. (Universal Product Code) indicia, such as described in copending, commonly assigned patent application Ser. No. 07/792,617, filed Nov. 15, 1991, which is hereby incorporated by reference in its entirety. Cartons 30, 32 are joined such that walls 10 are adjacent one another with their boundaries coextensive, and with flaps 18 folded down and positioned between walls 10, for reasons as will become apparent. Since panels 20*a* and 22*a* are folded over panels 20*b* and 22*b*, respectively, the free edge of each of panels 20*a* and 22*a* faces inwardly, between the two cartons. In this configuration, the free edges are relatively safe from being accidentally lifted from their place adjacent panels 20*b* and 22*b*, because the free edges are not readily accessible. Temporary closing means 42 is used to join flaps 16 to each other after they have been folded over the tops of their respective cartons to close the cartons.

Once label 40 and means 42 are applied, cartons 30, 32 form a dual carton which may be passed through commercially available tax-stamping machinery, adapted to process ten-pack cigarette cartons. Additional carrier means bearing adhesive similar to label 40 may be positioned across adjacent coplanar side walls 20 and 22 of cartons 30, 32 to more securely join the two cartons. Tax-stamping machines are typically designed to open and reseal cartons which have a flap on each wall. Hence, it is preferable that cartons 30, 32 be joined as shown in FIG. 2 with flaps 18 positioned between walls 10, so that only flaps 16 must be lifted to open the cartons. Once the required tax stamp is applied to the cigarette packs contained within the individual cartons, the cartons are ready to be sealed and distributed for sale to consumers.

Figure 3:
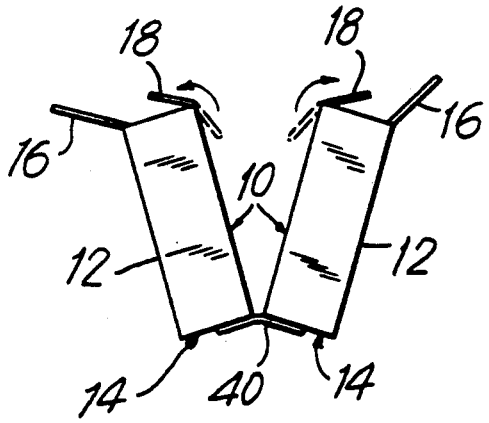
FIG. 3 is a side view of a step taken in sealing each carton of a dual carton configuration.

The initial step in sealing cartons 30, 32 is shown in FIG. 3. The cartons are pivoted along label 40, which joins the cartons, so that flaps 18 may be removed from between walls 10, and folded over the tops of the cartons. If labels such as label 40 are placed across adjacent side walls of cartons 30, 32 when in the dual carton configuration, such additional labels must be severed before this step. Hence, preferably at least one label is positioned only across the adjacent bottom walls of cartons 30, 32.

Figure 4:
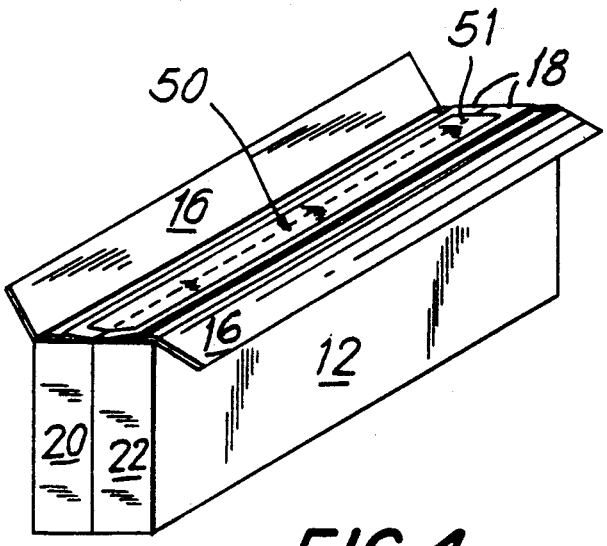
FIG. 4 is an isometric view of another step taken in sealing each carton of a dual carton configuration.
Figure 5:
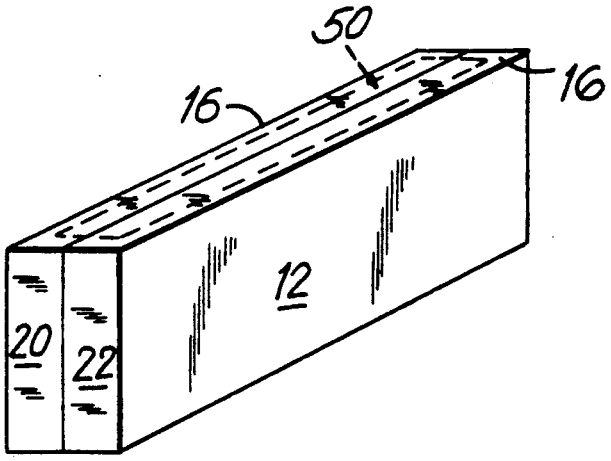
FIG. 5 is an isometric view of two sealed cartons joined to form a dual carton in accordance with this invention.

After panels 18 are folded over the tops of their respective cartons, a joining strip is placed over the top of panels 18, as shown in FIG. 4. Joining strip 50 preferably has a line of weakness, such as perforated line 51. Line 51 is preferably placed over the adjacent abutting edges of panels 18 to facilitate separation of the cartons, if desired, along line 51. Panels 16 are then folded over the tops of their respective cartons and are secured to joining strip 50 over their respective panel 18 to thereby seal the cartons. Any known adhesive, either permanent or releasable, may be used to secure panels 16 to joining strip 50. The dual carton thus formed appears as shown in FIG. 5. Joining strip 50 is shown in phantom and is not readily visible. The dual carton is joined along strip 50 and label 40, the latter being the only readily visible joining means. The cartons may be separated by twisting and separating the cartons along label 40, line 41, joining strip 50, and line 51, to cleanly separate the cartons for individual sale as two separate five-pack cartons.

Although joining strip 50 is shown as a single strip, joining strip 50 may be a strip formed of a number of unconnected shorter strips aligned to form a row across flaps 18.

Although cartons 30, 32 are described as each dimensioned to hold one row of five cigarette packs, they may be lengthened or shortened to hold more or fewer than five packs. Furthermore, it will be appreciated that these concepts may be applied to the connection of cartons of other configurations.

It will be appreciated that the directional references "top", "bottom", "front", and "rear" do not limit the respective panels to such orientation, but merely serve to distinguish these panels from one another.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions It will be understood that the foregoing is merely illustrative of the principles of the invention, and that various modifications can be made by those skilled in the art without departing from the scope and spirit of the invention. For example, such connection of cartons may be applied to any cartons, and is not limited to cigarette cartons. The present embodiments are described for the purpose of illustration rather than limitation, and the present invention is limited only by the claims which follow.

What is claimed is:

1. A dual carton comprising:

first and second cartons each having a first pair of first and second opposed walls, a second pair of third and fourth opposed walls, a bottom wall joining at least said first pair of opposed walls, a first extension flap extending from said first wall and having a free edge, and a second extension flap extending from said second wall and having a free edge; wherein:

said second extension flap is substantially the same width as said bottom wall such that said second extension flap extends across the top of said carton so that said free edge of said second extension flap lies adjacent said first wall when said second extension flap is folded over the top of said carton; and said first and second cartons are positioned adjacent one another with said first wall of said first carton adjacent and coextensive with said first wall of said second carton such that the borders of said coextensive walls are aligned; said dual carton further comprising:

means for joining said first extension flap of said first carton and said first extension flap of said second carton after said first extension flap of said first carton is folded over the top of said first carton and said first extension flap of said second carton is folded over the top of said second carton, such that said first and second cartons are joined to form said dual carton; and means for securing said second extension flap of said first carton and said second extension flap of said second carton to said means for joining said first extension flaps of said first and second cartons, such that said means for joining is hidden from view by said second extension flaps.

2. The dual carton of claim 1 wherein said means for joining said first extension flaps of said first and second cartons comprises a joining strip.

3. The dual carton of claim 2 wherein said joining strip includes a line of weakness positioned substantially above and parallel the adjacent abutting edges of said first extension flaps of said first and second cartons.

4. The dual carton of claim 3 wherein said line of weakness comprises a line of perforations.

5. The dual carton of claim 1 further including a second joining means positioned across said bottom walls of said first and second cartons to further secure said cartons together to form said dual carton.

6. The dual carton of claim 5 wherein said second joining means includes a line of weakness positioned substantially above and parallel the adjacent abutting edges of said bottom walls to facilitate separation of said first and second cartons.

7. The dual carton of claim 6 wherein said line of weakness comprises a line of perforations.

8. The dual carton of claim 5 wherein said second joining means bears indicia coded for automatic pricing of said dual carton.

9. The dual carton of claim 1 wherein:

each of said first and second cartons comprises a cigarette carton for packaging a first number of cigarette packs in each said carton, each said pack having a pair of front and rear long walls and a pair of opposed short walls;

the widths of said first and second walls of said first and second cartons are at least as wide as a second number of times the width of the long wall of said cigarette pack;

the widths of said third and fourth walls of said first and second cartons are at least as wide as a third number of times the width of the short wall of said cigarette pack; and said first number of cigarette packs, equal to the product of said second number of times the width of the long wall of said cigarette pack and said third number of times the width of the short wall of said cigarette pack, can be positioned inside each of said first and second cartons with said short walls of said packs parallel said third and fourth walls of said cartons, such that said dual carton contains twice said first number of cigarette packs.

10. The dual carton of claim 9 wherein said first number equals five.

11. The dual carton of claim 9 wherein said second number of times the width of the long wall of said cigarette pack is five.

12. The dual carton of claim 9 wherein said third number of times the width of the short wall of said cigarette pack is one.

13. A method for securing two cartons together to form a dual carton, said method comprising the steps of:

providing first and second cartons each having a first pair of first and second opposed walls, a second pair of third and fourth opposed walls, a bottom wall joining at least said first pair of opposed walls, a first extension flap extending from said first wall, and a second extension flap extending from said second wall;

positioning said first and second cartons adjacent one another with said first wall of said first carton adjacent and coextensive with said first wall of said second carton such that the borders of said adjacent walls are aligned; : folding said first extension flap of said first carton over the top of said first carton;

folding said first extension flap of said second carton over the top of said second carton;

positioning a joining means over said first extension flap of said first carton and said first extension flap of said second carton after said extension flaps are folded over the tops of said cartons, such that said first and second cartons are joined to form said dual carton; and securing said second extension flap of said first carton and said second extension flap of said second carton to said joining means.

14. The method of claim 13 wherein:

said second extension flap of each said carton has a free edge and is substantially the same width as said bottom wall of each said carton such that said second extension flaps of each said carton extend across the tops of said cartons so that said free edge lies adjacent said first wall when said second extension flap is folded over the tops of said cartons; and said step of securing said second extension flap of said first carton and said second extension flap of said second carton to said joining means further includes the step of concealing said joining means.

15. The method of claim 13 wherein said step of securing said second extension flaps of said first and second cartons to said joining strip includes the step of releasably securing said second extension flaps of said first and second cartons to said joining strip.

16. The method of claim 13 wherein said joining means has a line of weakness, said method further including the step of positioning said joining strip such that said line of weakness is substantially parallel the adjoining abutting edges of said first extension flaps to facilitate later separation of said cartons.

17. The method of claim 13 further including the step of positioning a second joining means across the bottom walls of said first and second cartons.

18. The method of claim 17 wherein said second joining means has a line of weakness, said method further including the step of positioning said second joining means such that said line of weakness is substantially parallel the adjoining abutting edges of said bottom walls to facilitate later separation of said first and second cartons.

19. A method for packaging cigarette packs which are to be passed through tax-stamping machinery used in the automated processing of cigarette cartons and later may be separated into groups of cigarette packs, said method comprising the steps of:

providing first and second cartons each having a first pair of first and second opposed walls, a second pair of third and fourth opposed walls, a bottom wall joining at least said first pair of opposed walls, a first extension flap extending from said first wall, and a second extension flap extending from said second wall;

folding said first extension flap of said first carton such that it lies adjacent the outside of said first carton adjacent said first wall;

folding said first extension flap of said second carton such that it lies adjacent the outside of said second carton adjacent said first wall;

positioning said first and second cartons adjacent one another with said first wall of said first carton adjacent and coextensive with said first wall of said second carton with said first extension flaps adjacent one another between said first and second cartons;

positioning securing means across the bottom walls of said first and second cartons to secure said first and second cartons together to form a dual carton of dimensions compatible with existent taxstamping machinery; folding said second extension flap of said first carton over the top of said first carton;

folding said second extension flap of said second carton over the top of said second carton;

positioning a temporary joining means over said second extension flap of said first carton and said second extension flap of said second carton to temporarily seal said first and second cartons in said dual carton configuration.

20. The method of claim 19 wherein said temporary joining means is released from securing said second extension panels of said first and second cartons to open said first and second cartons to apply a tax stamp to an end of each of the cigarette packs contained within said first and second cartons, said method further including the steps of:

pivoting said cartons about said bottom walls of said cartons to access said first extension flaps;

folding said first extension flap of said first carton over the top of said first carton;

folding said first extension flap of said second carton over the top of said second carton;

joining and sealing said first and second cartons along said extension flaps such that the means for joining and sealing said first and second cartons is concealed from view;

whereby said cigarette packs to which tax stamps have been applied may be distributed to consumers in a dual carton separable into individual cartons.

21. The method of claim 20 wherein said step of joining and sealing said first and second carton along said extension flaps further comprises the steps of:

positioning a joining strip across said first extension flaps of said first and second cartons after said extension flaps are folded over the tops of said cartons; and securing said second extension flap of said first carton and said second extension flap of said second carton to said joining strip.

22. The method of claim 21 wherein:

said second extension flap of each said carton has a free edge and is substantially the same width as said bottom wall of each said carton such that said second extension flaps of each said carton extend across the tops of said cartons so that said free edge lies adjacent said first wall when said second extension flap is folded over the tops of said cartons; and said step of securing said second extension flap of said first carton and said second extension flap of said second carton to said joining strip includes concealing said joining strip.

23. The method of claim 21 wherein said joining strip has a line of weakness, said method further including the step of positioning said joining strip such that said line of weakness is substantially parallel the adjoining edges of said first extension flaps to facilitate later separation of said first carton from said second carton.

24. The method of claim 21 wherein said step of securing said second extension flap of said first carton and said second extension flap of said second carton to said joining strip includes the step of releasably securing said second extension flap of said first carton and said second extension flap of said second carton to said joining strip.

25. The method of claim 19 further including the step of positioning securing means across at least one pair of adjacent side walls.

* * * * *